US008644719B2

(12) United States Patent
Shiiya et al.

(10) Patent No.: US 8,644,719 B2
(45) Date of Patent: Feb. 4, 2014

(54) CLEANING DEVICE, IMAGE FORMATION DEVICE, AND IMAGE FORMATION METHOD

(75) Inventors: Tomoyuki Shiiya, Nagano (JP); Satoshi Chiba, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 117 days.

(21) Appl. No.: 13/289,590

(22) Filed: Nov. 4, 2011

(65) Prior Publication Data

US 2012/0121307 A1 May 17, 2012

(30) Foreign Application Priority Data

Nov. 11, 2010 (JP) ..... 2010-252666

(51) Int. Cl.
*G03G 21/10* (2006.01)

(52) U.S. Cl.
USPC ..... 399/48

(58) Field of Classification Search
USPC ..... 399/71, 123, 149, 245, 326, 357, 233
See application file for complete search history.

(56) References Cited

U.S. PATENT DOCUMENTS 3,955,533 A * 5/1976 Smith et al. ..... 399/249
6,898,404 B2 * 5/2005 Sakai et al. ..... 399/249
2006/0127145 A1 * 6/2006 Honda et al. ..... 399/349

FOREIGN PATENT DOCUMENTS

JP 2006039142 A * 2/2006
JP 2009-031516 A 2/2009

* cited by examiner

*Primary Examiner* — Clayton E Laballe
*Assistant Examiner* — Victor Verbitsky
(74) *Attorney, Agent, or Firm* — Global IP Counselors, LLP

(57) ABSTRACT

A cleaning device includes a cleaning roller which contacts an intermediate transfer belt for carrying an image developed using a liquid developer, a cleaning roller which contacts the other cleaning roller and has a greater axial length than the other cleaning roller, and a rubber blade which contacts the cleaning roller and has a greater axial length than the cleaning roller.

7 Claims, 9 Drawing Sheets

CLEANING DEVICE, IMAGE FORMATION DEVICE, AND IMAGE FORMATION METHOD

CROSS-REFERENCE TO RELATED APPLICATIONS

This application claims priority to Japanese Patent Application No. 2010-252666 filed on Nov. 11, 2010. The entire disclosure of Japanese Patent Application No. 2010-252666 is hereby incorporated herein by reference.

BACKGROUND

1. Technical Field

The present invention relates to a cleaning device for cleaning a photoreceptor, an intermediate transfer body, or another image carrier for carrying an image developed using a liquid developer composed of a toner and a carrier solution; and an image formation device and image formation method which use this cleaning device.

2. Background Technology

A variety of wet image formation devices have been proposed in which there is used a liquid developer containing a toner composed of solid components and dispersed in a carrier solution to develop a latent image and make an electrostatic latent image visible. In the device disclosed in Patent Citation 1, for example, the visible image is conveyed to a two-dimensional transfer portion and transferred to paper while being carried on an intermediate transfer belt. A carrier removal portion is also provided in order to remove the carrier solution from the intermediate transfer belt. This carrier removal portion has a carrier removal roller which is in contact with the intermediate transfer belt, and the carrier solution is removed from the intermediate transfer belt by the carrier removal roller. A blade also comes in contact with the carrier removal roller and scrapes off the carrier solution that adheres to the peripheral surface of the carrier removal roller.

Japanese Patent Application Publication No. 2009-31516 (Patent Citation 1) is an example of the related art.

SUMMARY

Problems to be Solved by the Invention

In the device disclosed in Patent Citation 1, the carrier removal portion is used for removing the carrier solution, but it is also considered to be usable as a cleaning device for cleaning and removing the liquid developer from the intermediate transfer belt, photoreceptor, or other image carrier. However, when the carrier removal portion configured as described above is used in this state as a cleaning device, the following problems are encountered. Specifically, Patent Citation 1 does not specify the dimensional relationship between the axial length of the carrier removal roller and the width of the blade in the axial direction of the carrier removal roller, but a liquid ring is generated no matter what the relationship between these two dimensions. For example, when the axial length of the carrier removal roller is longer than the width of the blade in the axial direction, the liquid developer removed from the image carrier by the carrier removal roller collects on the end of the blade and a liquid ring is generated. The liquid ring then returns to the image carrier and the liquid developer adheres again. Conversely, when the axial length of the carrier removal roller is shorter than the width of the blade in the axial direction, the liquid developer removed from the image carrier collects on the roller end of the carrier removal roller, a liquid ring is generated, and the same problem occurs.

An advantage of several aspects according to the invention is to provide a technique for inhibiting the liquid developer constituting the liquid ring from returning and adhering again to an image carrier in a cleaning device for cleaning and removing liquid developer adhering to the image carrier, as well as in an image formation device and image formation method which use this cleaning device.

Means Used to Solve the Above-Mentioned Problems

A first aspect of the invention is characterized in comprising a first cleaning roller which contacts an image carrier for carrying an image developed using a liquid developer including a toner and a liquid carrier, a second cleaning roller which contacts the first cleaning roller and has a greater length in an axial direction than the first cleaning roller, and a cleaning blade which contacts the second cleaning roller and has a greater length in the axial direction of the second cleaning roller than the first cleaning roller.

A second aspect of the invention is characterized in comprising a developing portion for developing using a liquid developer including a toner and a liquid carrier, an image carrier for carrying an image developed using the developing portion; a transfer portion for transferring the image carried on the image carrier onto a transfer member, and a cleaning portion for cleaning the image carrier, the cleaning portion having a first cleaning roller which makes contact with the image carrier via which the image is transferred onto the transfer member in the transfer portion, a second cleaning roller which makes contact with the first cleaning roller and has a greater length in an axial direction than the first cleaning roller, and a cleaning blade which makes contact with the second cleaning roller and has a greater length in the axial direction of the second cleaning roller than the first cleaning roller.

Furthermore, a third aspect of the invention is characterized in that an image developed using a liquid developer including a toner and a liquid carrier is carried on an image carrier, the image carried on the image carrier is transferred to a transfer member, after the image has been transferred to the transfer member, a first cleaning roller is caused to make contact with the image carrier so that the image carrier is cleaned; a second cleaning roller having greater length in an axial direction than the first cleaning roller is caused to make contact with the first cleaning roller so that the first cleaning roller is cleaned; and a cleaning blade having greater length in the axial direction of the second cleaning roller than the first cleaning roller is caused to make contact with the second cleaning roller so that the second cleaning roller is cleaned.

In the invention (the cleaning device, the image formation device, and the image formation method) of the above aspects, liquid developer that adheres to the image carrier is removed from the image carrier by the first cleaning roller which contacts the image carrier. The liquid developer removed in this manner from the image carrier is also removed from the first cleaning roller by the second cleaning roller which contacts the first cleaning roller. The liquid developer removed from the first cleaning roller adheres to the second cleaning roller, and this accretion is scraped off by the cleaning blade which contacts the second cleaning roller, but some of this accretion sometimes collects on the end of the second cleaning roller or the end of the cleaning blade and a liquid ring is generated. Since the axial length of the second cleaning roller and the width of the cleaning blade in the axial direction of the second cleaning roller are both greater than the axial length of the first cleaning roller, the liquid ring is generated farther outward in the axial direction than the end of the first cleaning roller. Therefore, the liquid developer constituting the liquid ring is inhibited from returning to the first cleaning roller, and as a result, the liquid developer is inhibited from adhering again to the image carrier.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
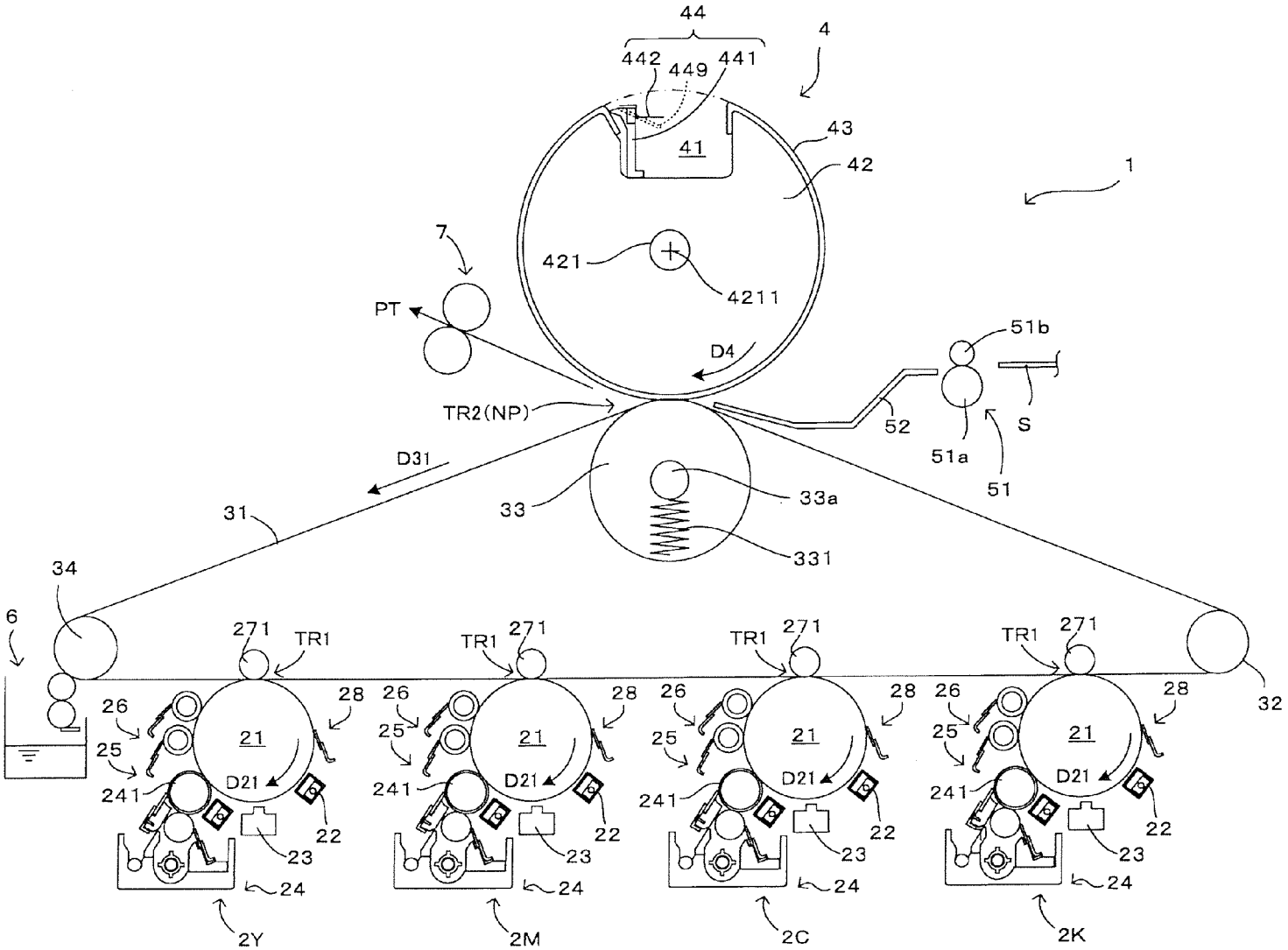
FIG. 1 is a drawing representing an image formation device comprising a first embodiment according to the invention (cleaning device)

FIG. 1 is a drawing representing an image formation device comprising a first embodiment of a cleaning device according to the invention. This image formation device 1 comprises four image formation stations 2Y (yellow), 2M (magenta), 2C (cyan), and 2K (black) for forming images of mutually different colors. The image formation device 1 can selectively execute a color mode for forming color images by superimposing toners of the four colors yellow (Y), magenta (M), cyan (C), and black (K), and a monochrome mode for forming monochrome images using only black (K) toner. In this image formation device 1, when an image formation command is sent from a host computer or another external device to a controller (not shown) having a CPU, memory, and the like, this controller controls the other components of the device to execute a predetermined image-forming action, and an image corresponding to the image formation command is formed on a sheet-shaped transfer member S such as copying paper, transfer paper, all-purpose paper, and OHP transparent sheets.

The image formation stations 2Y, 2M, 2C, and 2K are provided with photoreceptor drums 21 on whose surfaces are formed toner images of the respective colors. The photoreceptor drums 21 are arranged so that their rotational axes are parallel or substantially parallel to the main scanning direction (the direction perpendicular to the plane of FIG. 1 as it appears on the page), and the drums are rotatably driven at a predetermined speed in the directions of the arrows D21 in FIG. 1.

Around the periphery of each photoreceptor drum 21, a charging unit 22 which is a corona charging unit for charging the surface of the photoreceptor drum 21 to a predetermined electric potential, an exposure unit 23 for forming electrostatic latent images by exposing the surface of the photoreceptor drum 21 to image signals, a developing unit 24 for visualizing the electrostatic latent images as toner images, a first squeeze portion 25, a second squeeze portion 26, a primary transfer unit for primary-transferring the toner images to an intermediate transfer belt 31, and a cleaning portion 28 for cleaning the surface of the photoreceptor drum 21 after the primary transfer are set up in the stated order along the rotational direction D21 (clockwise in FIG. 1) of the photoreceptor drum 21.

The charging unit 22 does not come in contact with the surface of the photoreceptor drum 21, and a well-known common corona charging unit can be used as the charging unit 22. When a scorotron charging unit is used as the corona charging unit, a wire current flows to a charge wire of the scorotron charging unit, and a direct-current (DC) grid charging bias is applied to a grid. The electric potential of the surface of the photoreceptor drum 21 is set to a substantially uniform electric potential by the photoreceptor drum 21 being charged by the corona discharge of the charging unit 22.

The exposure unit 23 exposes the surface of the photoreceptor drum 21 using a light beam according to an image signal sent from the external device and forms an electrostatic latent image corresponding to the image signal. The exposure unit 23 can be configured as something that causes the light beam from a semiconductor laser to scan using a polygon mirror, as a line head in which light-emitting elements are arrayed in the main scanning direction, or as another format.

Toner is applied to the electrostatic latent image formed in this manner from a developing roller 241 provided to the developing units 24, and the electrostatic latent image is developed using the toner. In the developing units 24 of this image formation device 1, toner developing is performed using a liquid developer in which toner is dispersed in a carrier solution at a weight ratio of substantially 20%. The liquid developer used in this embodiment is not a well-know common volatile liquid developer which uses Isopar (trademark: Exxon) as a carrier solution, which is low in both concentration (1 to 2 wt %) and viscosity, and which is volatile at room temperature; but is a nonvolatile liquid developer which is high in both concentration and viscosity and is nonvolatile at room temperature. Specifically, the liquid developer in the present embodiment is a high-viscosity liquid developer (the viscoelasticity was about 30 to 300 MPa·s when the shear rate at 25° C. was 1000 (1/S) using the HAAKE RheoStress RS600) in which solid particles composed of a pigment or another colorant dispersed in a thermoplastic resin and having a mean grain diameter of 1 μm are added along with a dispersant to a liquid solvent such as an organic solvent, silicone oil, mineral oil, or cooking oil; and the toner solid content concentration is approximately 20%.

The first squeeze portion 25 is arranged downstream of the developing position in the rotational direction D21 of the photoreceptor drum 21, and the second squeeze portion 26 is arranged downstream of the first squeeze portion 25. Squeeze rollers are provided respectively to the squeeze portions 25, 26. The squeeze rollers contact the surface of the photoreceptor drum 21 and remove excess carrier solution and toner fogging from the toner image. In the present embodiment, the excess carrier solution and toner fogging are removed by two squeeze portions 25, 26, but the number, arrangement, and other features of the squeeze portions are not limited to those here. For example, a single squeeze portion may be arranged.

The toner image that has passed through the squeeze portions 25, 26 is primarily transferred to the intermediate transfer belt 31 by the primary transfer unit. The intermediate transfer belt 31 is an endless belt constituting an image carrier capable of temporarily carrying a toner image on its surface, or more specifically on its external peripheral surface, and is wrapped around a plurality of rollers 32, 33, and 34. The roller 32 is mechanically connected to a belt drive motor (not shown), and this roller functions as a belt drive roller for revolvably driving the intermediate transfer belt 31 in the direction of arrow D31 in FIG. 1.

Of the rollers 32 to 34 around which the intermediate transfer belt 31 is wrapped, only the aforementioned belt drive roller 32 is driven by the motor, and the other rollers 33, 34 are driven rollers that do not have a drive source. The intermediate transfer belt 31 wraps over the belt drive roller 32 downstream of primary transfer positions TR1 in the belt movement direction D31 and upstream of a secondary transfer position TR2, which is described hereinafter.

Each primary transfer unit has a primary transfer backup roller 271, and the primary transfer backup roller 271 is set up facing the photoreceptor drum 21 with the intermediate transfer belt 31 in between. In each primary transfer position TR1 where the photoreceptor drum 21 and the intermediate transfer belt 31 come in contact, a primary transfer nip is fowled by this contact, and the toner image on the photoreceptor drum 21 is transferred by this primary transfer nip to the external peripheral surface of the intermediate transfer belt 31 (the bottom surface in the primary transfer position TR1). Transfer of the toner image is executed at each of the image formation stations 2Y, 2M, 2C, and 2K, whereby a toner image of each color is superimposed in sequence on the intermediate transfer belt 31 and a full-color toner image is formed. When a monochrome toner image is formed, the toner image is transferred to the intermediate transfer belt 31 only in the image formation station 2K corresponding to the color black.

The toner image transferred to the intermediate transfer belt 31 in this manner is conveyed to the secondary transfer position TR2 via the position where the belt wraps around the belt drive roller 32. In this secondary transfer position TR2, a secondary transfer roller 4 is statically arranged, facing the roller 33 over which the intermediate transfer belt 31 wraps, the intermediate transfer belt 31 being in between the roller 4 and the roller 33, and the surface of the intermediate transfer belt 31 and the peripheral surface of the transfer roller 4 (excluding a concave portion 41) come in contact with each other to form a transfer nip NP. Specifically, the roller 33 functions as a secondary transfer backup roller, and a rotating shaft 33*a* of the backup roller 33 is supported elastically by an urging portion 331 which is an elastic member such as a spring, so that the shaft is free to move toward and away from the intermediate transfer belt 31.

In this secondary transfer position TR2, the monochromatic or polychromatic toner image formed on the intermediate transfer belt 31 is secondarily transferred from gate rollers 51 (a pair of rollers 51*a*, 51*b*) to a transfer member S conveyed along a conveying route PT. Between the gate rollers 51 and the secondary transfer position TR2, a transfer member guide 52 is set up for feeding the transfer member S to the secondary transfer position TR2 without bringing the transfer member S in contact with the secondary transfer roller 4 or the intermediate transfer belt 31. In this embodiment, toner images are formed by a wet developing system for forming toner images using a liquid developer. Therefore, in order to obtain satisfactory transfer characteristics, it is preferable that the transfer member S be pressed with a high pressing force against the intermediate transfer belt 31 in the secondary transfer nip NP. Due to the medial location of the liquid developer, it is highly possible that the transfer member S will stick to the intermediate transfer belt 31 and cause jamming. In view of this, the image formation device 1 uses the secondary transfer roller 4 in which a concave portion is provided in a part of the peripheral surface and a gripping portion is set up in this concave portion.

The secondary transfer roller 4 has a roller base member 42 which is provided with the concave portion 41, a cut-away part of the external peripheral surface of a cylinder. In this roller base member 42, a rotating shaft 421 capable of rotating in a direction D4 around a rotating shaft 4211 is arranged parallel or substantially parallel with the rotating shaft 33*a* of the secondary transfer backup roller 33. The secondary transfer roller 4 receives rotational drive force from a motor (not shown) and rotates in a fixed position in the direction D4 around the rotating shaft 4211.

An elastic layer 43 made of rubber, resin, or the like is formed on the external peripheral surface of the roller base member 42, i.e., on the surface region of a metal plate surface excluding the region corresponding to the inside of the concave portion 41. This elastic layer 43 faces the intermediate transfer belt 31 wound over the backup roller 33, forming the secondary transfer nip NP. In the secondary transfer nip NP, the backup roller 33 is urged toward the secondary transfer roller 4 by the urging portion 331, and a predetermined load is applied between the secondary transfer roller 4 and the intermediate transfer belt 31 wound over the backup roller 33.

A gripping portion 44 for gripping the transfer member S is set up inside the concave portion 41. This gripping portion 44 has a gripper support member 441 rising from the inside bottom of the concave portion 41 to the external peripheral surface of the roller base member 42, a gripper member 442 supported so as to be free to contact and separate from the distal end of the gripper support member 441, and a transfer member peeling member 449. The gripper member 442 is connected to a gripper drive portion (not shown). The gripper driver portion actuates upon receiving a command from the controller to release the grip, and the distal end of the gripper member 442 thereby separates from the distal end of the gripper support member 441, either preparing to grip or releasing its grip on the transfer member S. The gripper driver portion also actuates upon receiving a command from the controller to enable gripping, and the distal end of the gripper member 442 thereby moves to the distal end of the gripper support member 441 to grip the transfer member S. By providing the gripping portion 44 in this manner, the transfer member S can be reliably held, and the transfer member S can be peeled away from the intermediate transfer belt 31 after the toner image carried on the intermediate transfer belt 31 has been transferred to the transfer member S.

The transfer member peeling member 449 appropriately spans across the axial direction of the secondary transfer roller 4 between the pair constituted by the gripper member 442 and the gripper support member 441. The transfer member peeling member 449 moves to protrude toward the radially outward side of the secondary transfer roller 4, thereby serving to push the transfer member S which is gripped by the gripper member 442 and the gripper support member 441, out away from the secondary transfer roller 4. Therefore, when the distal end of the gripper member 442 has separated from the distal end of the gripper support member 441 and the grip on the transfer member S has been released, the transfer member S can be reliably peeled away from the secondary transfer roller 4 by further causing the transfer member peeling member 449 to act. The configuration of the gripping portion 44 is not limited to the present embodiment; other well-known gripping mechanisms may be used.

The transfer member S, with the toner image secondarily transferred, is fed out from the secondary transfer roller 4 to a fixing unit 7 provided in the conveying route PT. In the fixing unit 7, the toner image transferred to the transfer member S is subjected to heat, pressure, or the like, fixing the toner image to the transfer member S.

A cleaning portion 6 is provided facing the intermediate transfer belt 31 on which the toner image has been secondarily transferred, and the cleaning portion 6 removes the toner, carrier solution, and other remaining deposits that remain on the surface of the intermediate transfer belt 31 after the secondary transfer. The configuration and action of the cleaning portion 6 are described in detail hereinbelow with reference to FIGS. 1 and 2.

Figure 2:
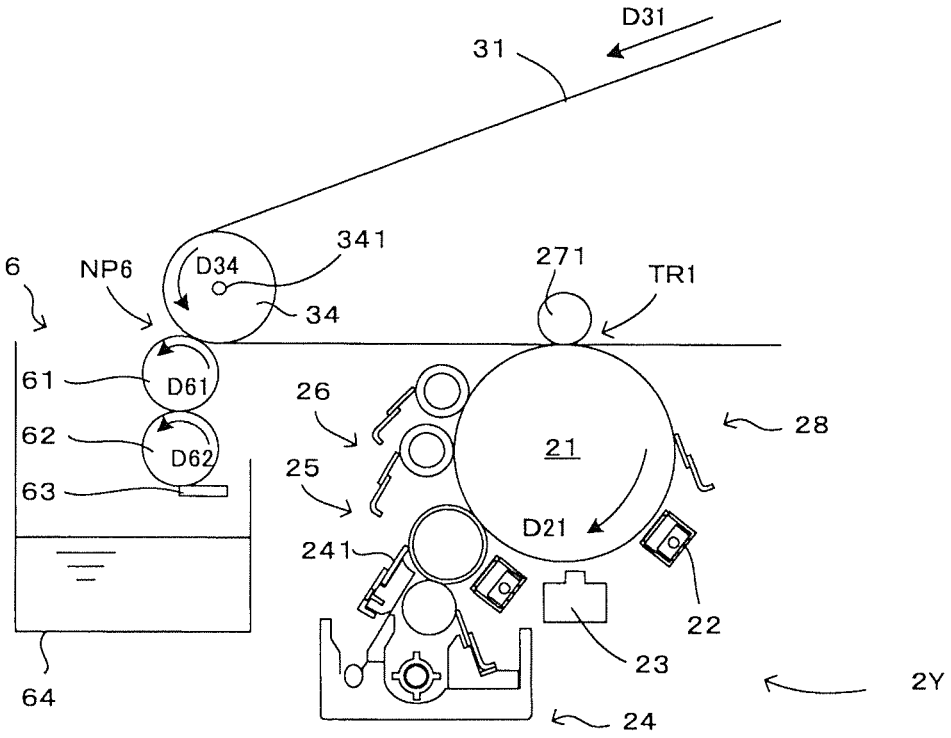
FIG. 2 is a drawing representing the first embodiment of the cleaning device according to the invention.
Figure 3A:
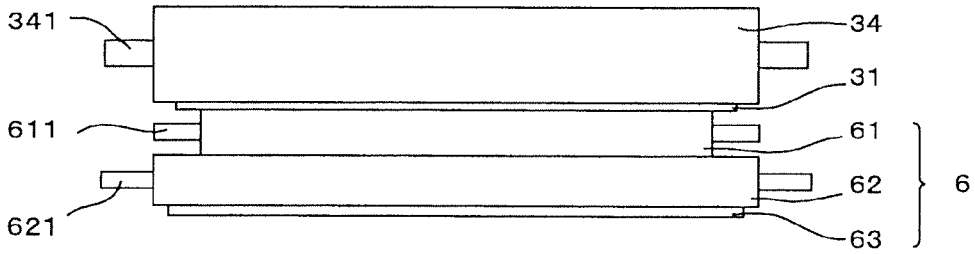
FIG. 3 is a drawing representing the arrangement and dimensional relationship of the components constituting the cleaning portion.
Figure 3B:
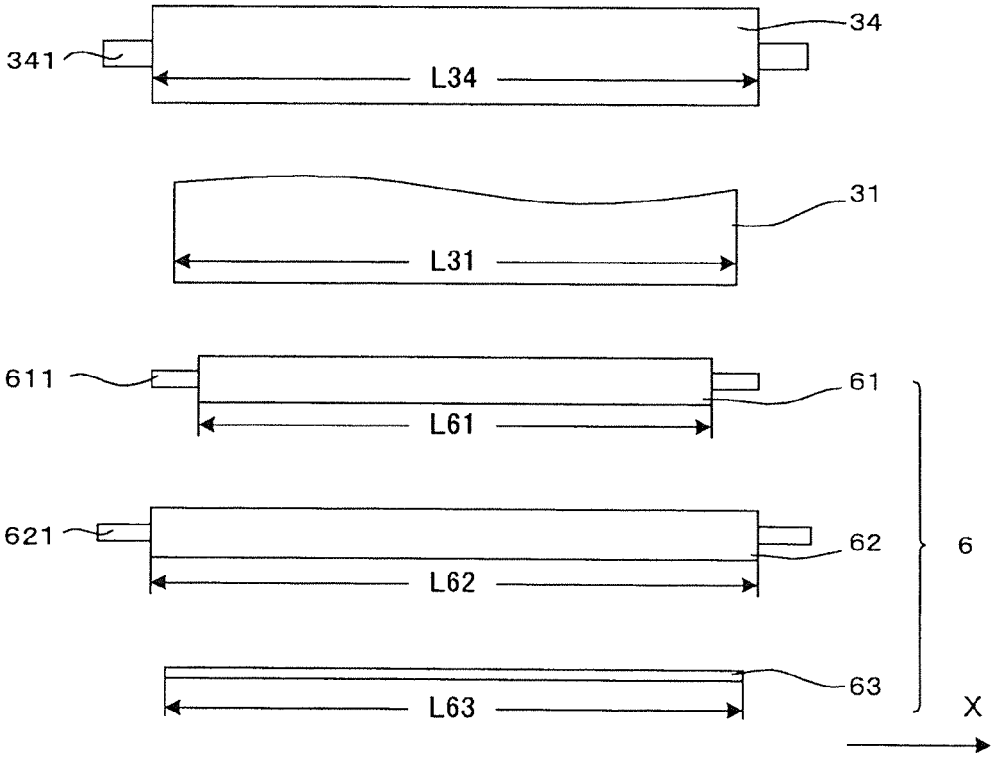

FIG. 2 is a drawing showing the cleaning portion in a first embodiment of the cleaning device according to the invention. FIG. 3 is a drawing showing the arrangement and dimensional relationship of the components constituting the cleaning portion, wherein FIG. 3A is a drawing showing the relationship of arrangement between the cleaning rollers and the rubber blade, and FIG. 3B is a drawing showing the dimensional relationship of the cleaning rollers and the rubber blade in the axial direction. This cleaning portion 6 comprises two cleaning rollers 61, 62, a rubber blade 63, and a developer recovery box 64, as shown in FIGS. 1 and 2.

The cleaning roller 61 is arranged facing the roller 34 from a diagonal direction with the intermediate transfer belt 31 in between as shown in FIG. 2, and the roller peripheral surface of the roller 61 is in contact with the surface of the intermediate transfer belt 31. Therefore, a nip position NP6, where the cleaning roller 61 and the roller 34 are in contact, is positioned below an imaginary horizontal plane passing through the rotating shaft 341 of the roller 34. The rotating shaft 611 of the cleaning roller 61 is arranged parallel or substantially parallel to the rotating shaft 341 of the roller 34, and, on receiving rotational drive force from a belt cleaning motor (not shown) the cleaning roller 61 rotates counter to the intermediate transfer belt 31. The liquid developer or solid components of the toner remaining on the intermediate transfer belt 31 are thereby rubbed off at the nip position NP6 and conveyed in a rotating direction D61 of the roller 61. Therefore, residue can be efficiently removed from the intermediate transfer belt 31.

The cleaning roller 62 is arranged in a position below the cleaning roller 61, and the roller peripheral surface of the roller 62 is in contact with the roller peripheral surface of the roller 61. The rotating shaft 621 of the cleaning roller 62 is arranged parallel or substantially parallel to the rotating shaft 611 of the roller 61, and, on receiving rotational drive force from a belt cleaning motor, the cleaning roller 62 rotates counter to the roller 61. The liquid developer or toner solid components adhering to the peripheral surface of the cleaning roller 61 can thereby be efficiently removed from the roller 61 onto the roller 62, similar to the description above.

The rubber blade 63 is arranged in a position below the cleaning roller 62. The rubber blade 63 is fashioned into a substantial plate shape extending in an axial direction X of the cleaning rollers 61, 62 (the direction perpendicular to the planes of FIGS. 1 and 2 as they appear on the page), and the distal end of the blade is in contact with the roller peripheral surface of the roller 62. Liquid developer and toner solid components are thereby removed from the roller peripheral surface of the cleaning roller 62, recovered in the developer recovery box 64, and stored. In this embodiment, a blade made of rubber is used, but the blade material is not limited to rubber, and can be configured from a material used in well-known cleaning devices. This similarly applies to other blades as well.

Thus, in the present embodiment, the two cleaning rollers 61, 62 and the rubber blade 63 are combined to remove liquid developer and other residue from the intermediate transfer belt 31, and these components have a dimensional relationship such as is shown in FIG. 3B. Specifically, in the present embodiment, the roller 34, the intermediate transfer belt 31, the roller 61, the roller 62, and the rubber blade 63 have the following dimensional relationship in the axial direction X of the rollers 34, 61, 62. Specifically, when the parameters are defined as follows:

L34: Axial length of roller 34

L31: Length in axial direction X, i.e. width, of intermediate transfer belt 31

L61: Axial length of cleaning roller 61

L62: Axial length of cleaning roller 62

L63: Length in axial direction X, i.e. width, of rubber blade 63 then in the position where the intermediate transfer belt 31 is wound on the roller 34, the dimensional relationship $$L34 > L31 \qquad \text{Expression (1)}$$

holds true, and when the dimensions of the intermediate transfer belt 31, the cleaning roller 62, and the rubber blade 63 are compared with that of the cleaning roller 61, the dimensional relationships $$L61 < L31 \qquad \text{Expression (2)}$$

$$L61 < L62 \qquad \text{Expression (3)}$$

$$L61 < L63 \qquad \text{Expression (4)}$$

hold true.

Since such dimensional relationships hold true, the following actions and effects are obtained in the present embodiment. In the cleaning portion 6 configured in this manner, the liquid developer and the like adhering to the intermediate transfer belt 31 is removed from the intermediate transfer belt 31 by the cleaning roller 61 in contact with the intermediate transfer belt 31. The liquid developer and the like removed from the cleaning roller 61 is then shifted to the cleaning roller 62, then scraped off of the cleaning roller 62 by the rubber blade 63, and recovered and stored in the developer recovery box 64. The liquid developer and the like removed from the intermediate transfer belt 31 in such a route is moved to the developer recovery box 64, and some of the liquid developer occasionally accumulates in part of the cleaning portion 6 to generate a liquid ring. In the present embodiment, since the above expressions (2) through (4) are satisfied, the position where the liquid ring forms is the end of the rubber blade 63.

Even if a liquid ring has been generated on the edge of the rubber blade 63 in this manner, since the expressions (3) and (4) are satisfied in the present embodiment, the liquid developer and the like constituting the liquid ring do not return to the cleaning roller 61, and the liquid developer can be inhibited from re-adhering onto the intermediate transfer belt 31.

In the present embodiment, the cleaning roller 61 is caused to rotate counter to the intermediate transfer belt 31. Therefore, the liquid developer and the like remaining on the intermediate transfer belt 31 can be rubbed off at the nip position NP6 where the roller contacts the intermediate transfer belt 31, causing the liquid developer to move to the cleaning roller 61. As a result, the residue can be efficiently removed from the intermediate transfer belt 31. This similarly applies in the position of contact between the cleaning rollers 61, 62. In other words, since the cleaning roller 62 rotates counter to the cleaning roller 61, the efficiency of removal from the roller 61 to the roller 62 can be increased.

According to the present embodiment, the liquid developer and the like remaining on the intermediate transfer belt 31 can be removed with high efficiency and recovered in the developer recovery box 64 while being inhibited from re-adhering onto the intermediate transfer belt 31. As a result, it is possible to inhibit the liquid developer and the like remaining on the intermediate transfer belt 31 from bypassing the cleaning portion 6 and being conveyed to the image formation stations 2Y, 2M, 2C, and 2K, to reduce the occurrence of color mixing in the image formation stations, and to improve image quality.

Thus, in the first embodiment, the cleaning rollers 61, 62 are respectively equivalent to the "first cleaning roller" and the "second cleaning roller" of the invention. The intermediate transfer belt 31 is equivalent to the "image carrier" of the invention. The rollers 32, 33, 34 are equivalent to the "harnessing rollers" of the invention.

To prevent offsetting of the intermediate transfer belt 31, an offsetting prevention technique of a "bead system" is employed in the image formation device. The invention can also be applied to an image formation device employed in this offsetting prevention technique. In the image formation device 1 shown in FIG. 4, for example, to correspond to the application of the offsetting prevention technique, the device is configured so that the dimensional relationship $$L34<L31 \qquad \text{Expression (5)}$$

holds true at the position where the intermediate transfer belt 31 is wound on the roller 34. The other dimensional relationships, i.e. the expressions (2) through (4) above are satisfied. Therefore, the same actions and effects as the first embodiment described above are obtained. The embodiment shown in FIG. 4 also has the following advantageous actions and effects in comparison with the common configuration (FIG. 5) of the cleaning portion in an image formation device equipped with the offsetting prevention technique. The actions and effects are described hereinbelow while comparing FIGS. 4 and 5.

Figure 5A:
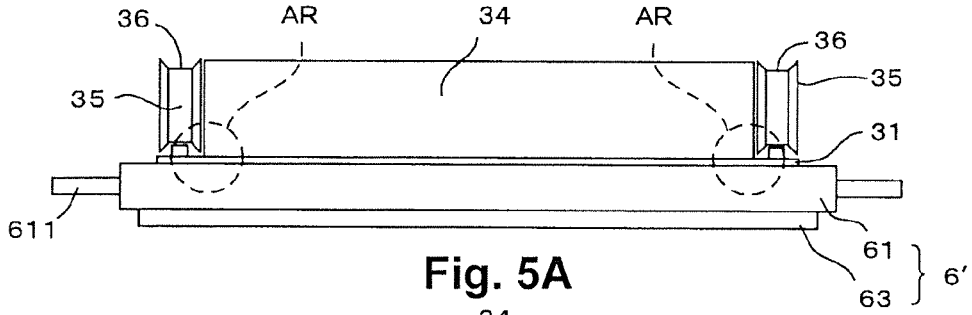
FIG. 5 is a drawing representing a comparative example of the cleaning portion.
Figure 5B:
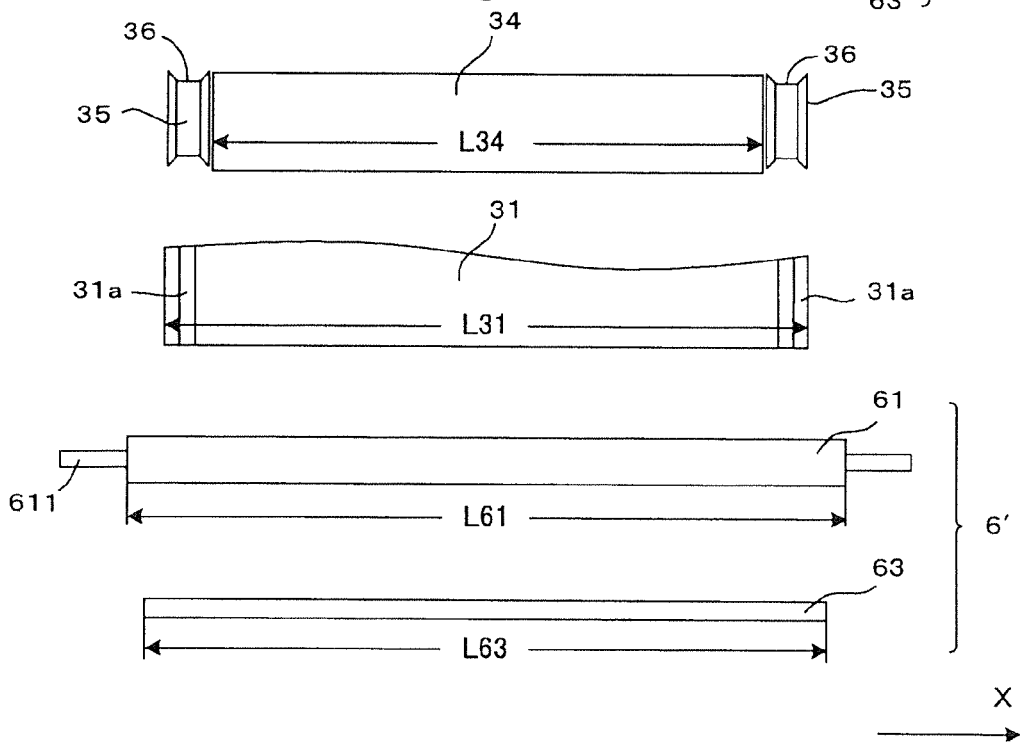

FIG. 5 is a drawing showing a comparative example of the cleaning portion. The cleaning portion 6' shown in FIG. 5 has one cleaning roller 61 and a rubber blade 63. To inhibit the liquid developer and the like constituting the liquid ring generated in the cleaning portion 6' from returning to the intermediate transfer belt 31, the cleaning portion 6' must be configured so that the axial length of the cleaning roller 61 is greater than the length of the intermediate transfer belt 31 in the axial direction X, i.e. the width. Furthermore, the axial length of the roller 34 must be less than the width of the intermediate transfer belt 31 in order to correspond with the offsetting prevention technique of the "bead" system. As a result, the cleaning roller 61, which is softer than the roller 34, is across its entire width in contact with the surface of the intermediate transfer belt 31, and the roller 34, which is harder than the cleaning roller 61, is in contact with the middle of the back surface of the intermediate transfer belt 31, leaving both ends free on the reverse side. Therefore, in the locations shown by the symbols AR in FIG. 5, the edges of the roller 34 press the intermediate transfer belt 31 against the cleaning roller 61, creating excessive stress.

Figure 4A:
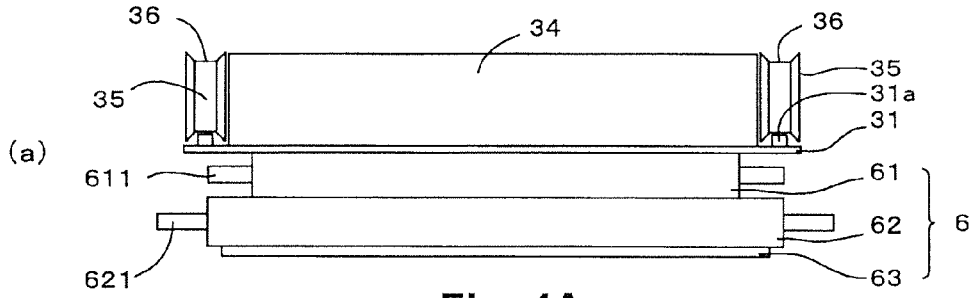
FIG. 4 is a drawing representing a second embodiment of the cleaning device according to the invention.
Figure 4B:
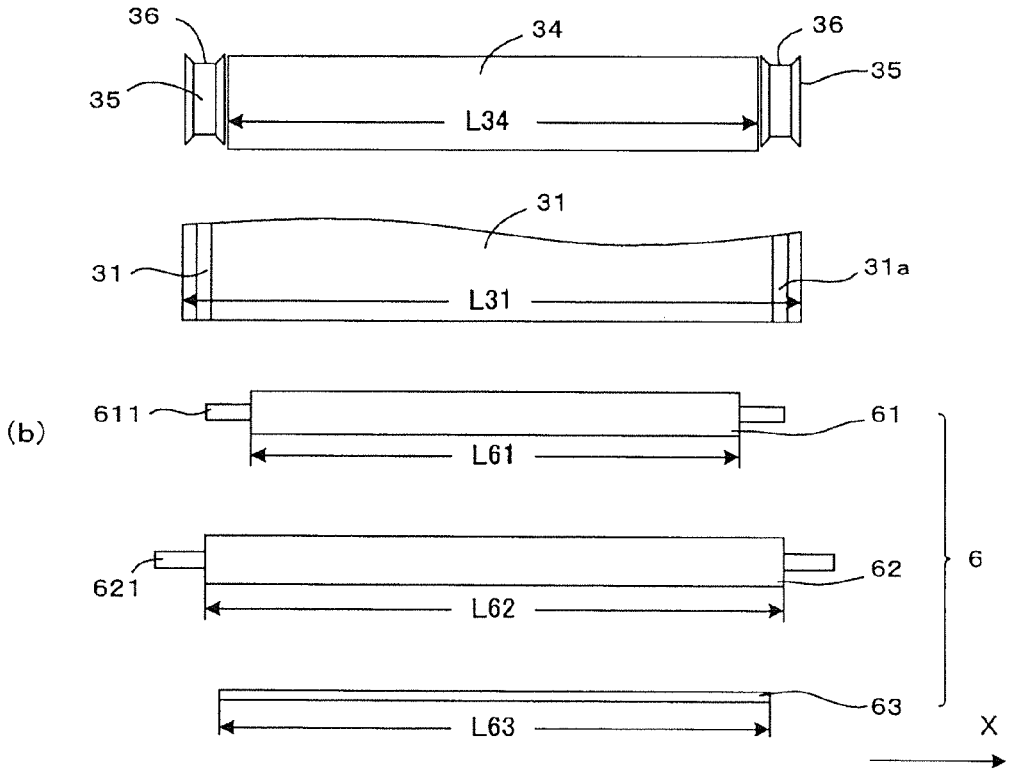

In the cleaning portion 6 shown in FIG. 4 of the second embodiment of the cleaning device according to the invention, to comply with applying the offsetting prevention technique, the configuration is designed so that the dimensional relationship of Expression (5) above holds true at the position where the intermediate transfer belt 31 is wound on the roller 34, and the dimensional relationship between the roller 34 and the cleaning roller 61 is $$L34>L61 \qquad \text{Expression (6).}$$

In other words, in the invention, the dimensional relationship between the roller 34 and the cleaning roller 61 can be set as desired because the liquid developer and the like constituting the liquid ring is prevented from returning to the intermediate transfer belt 31 by using the two cleaning rollers 61, 62 and designing the configuration so that the above expressions (2) through (4) are satisfied. Therefore, it is also possible to configure the roller 34 and the cleaning roller 61 so that the above Expression (6) is satisfied, and using such a dimensional relationship makes it possible to prevent excessive stress from being applied to the intermediate transfer belt 31 while inhibiting the liquid developer constituting the liquid ring from re-adhering to the intermediate transfer belt 31 in an image formation device that applies the "bead" system offsetting prevention technique.

The symbols 31*a*, 35, and 36 in FIG. 4 indicate well-known configurational components provided in order to apply the offsetting prevention technique to the image formation device 1, wherein the symbol 31*a* indicates a bead provided to both sides of the intermediate transfer belt 31, the symbol 35 indicates an offsetting prevention member, and the symbol 36 indicates a guide groove provided to the offsetting prevention member 35.

Figure 6:
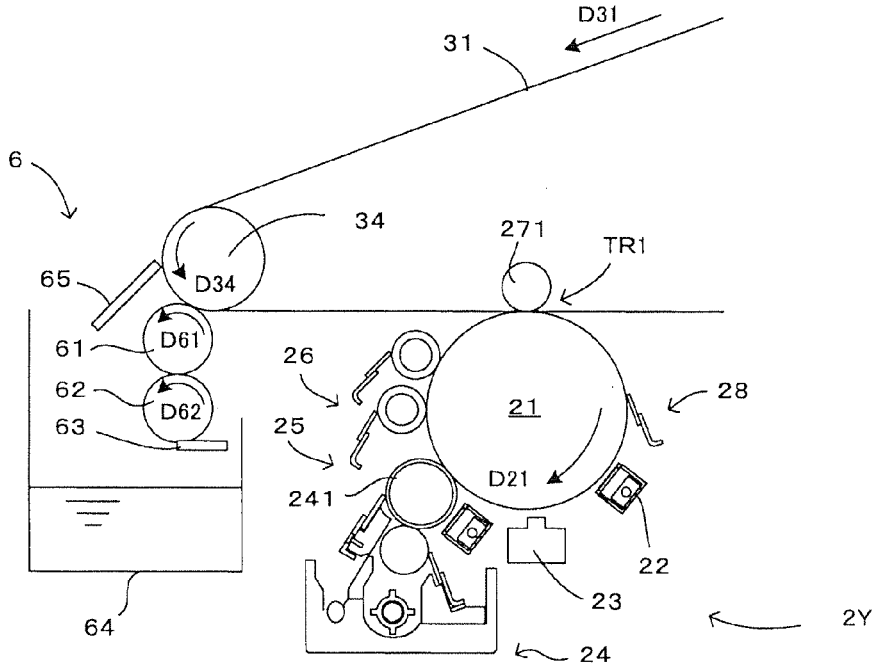
FIG. 6 is a drawing representing a third embodiment of the cleaning device according to the invention.

FIG. 6 is a drawing showing a third embodiment of the cleaning device according to the invention. The third embodiment significantly differs from the first embodiment in that a rubber blade 65 is provided, but the configuration is otherwise the same. The rubber blade 65 is arranged upstream of the cleaning roller 61 in the belt movement direction D31, and the distal end of the blade contacts the intermediate transfer belt 31 wound over the roller 34 and cleans the intermediate transfer belt 31. Thus, in the third embodiment, as a continuation of the surface of the intermediate transfer belt 31 being cleaned by a blade system, the surface region that is cleaned is cleaned by the roller 61.

Figure 7:
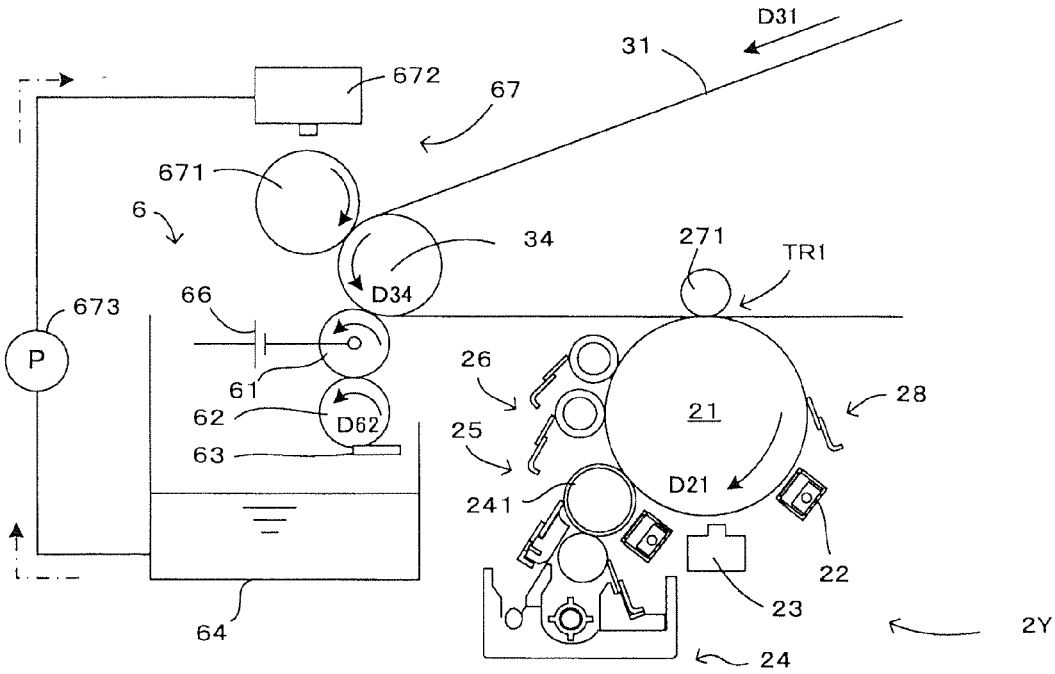
FIG. 7 is a drawing representing a fourth embodiment of the cleaning device according to the invention.

FIG. 7 is a drawing showing a fourth embodiment of the cleaning device according to the invention. This fourth embodiment significantly differs from the first embodiment in that a bias generator 66 for applying a cleaning bias is added to the cleaning roller 61 and a liquid coater 67 is added, but the configuration is otherwise the same.

This bias generator 66 is electrically connected to the cleaning roller 61, bias voltage is applied with a polarity corresponding to the charged polarity of the toner, whereby charged solid components in the liquid developer adhering to the intermediate transfer belt 31 are drawn onto the cleaning roller 61 and the belt can satisfactorily cleaned.

The liquid coater 67 comprises a coating roller 671, a liquid coating head 672 and a pump 673. A sponge roller, for example, is used as the coating roller 671, which is in contact with and driven to rotate by the intermediate transfer belt 31 wound on the roller 34 upstream of the cleaning roller 61 in the belt movement direction D31. The liquid coating head 672 is arranged directly above the coating roller 671, liquid developer stored in the developer recovery box 64 is pressure-fed to a nozzle (not shown) by the pump 673, and the liquid developer is supplied from the nozzle to the coating roller 671. When the liquid developer is supplied to the coating roller 671 in this manner, the liquid developer is coated on the intermediate transfer belt 31 by the coating roller 671 immediately before the cleaning process is executed by the cleaning roller 61. The percentage of toner solid components on the intermediate transfer belt 31 thereby decreases, and it is easier for the cleaning roller 61 to clean and remove the toner solid components. In the present embodiment, the liquid developer recovered and stored in the developer recovery box 64 is used, but the configuration may also be designed so that water, the carrier solution, or another liquid that can lower the toner solid component percentage is supplied instead of the liquid developer. This also applies in the embodiments described hereinafter.

Figure 8:
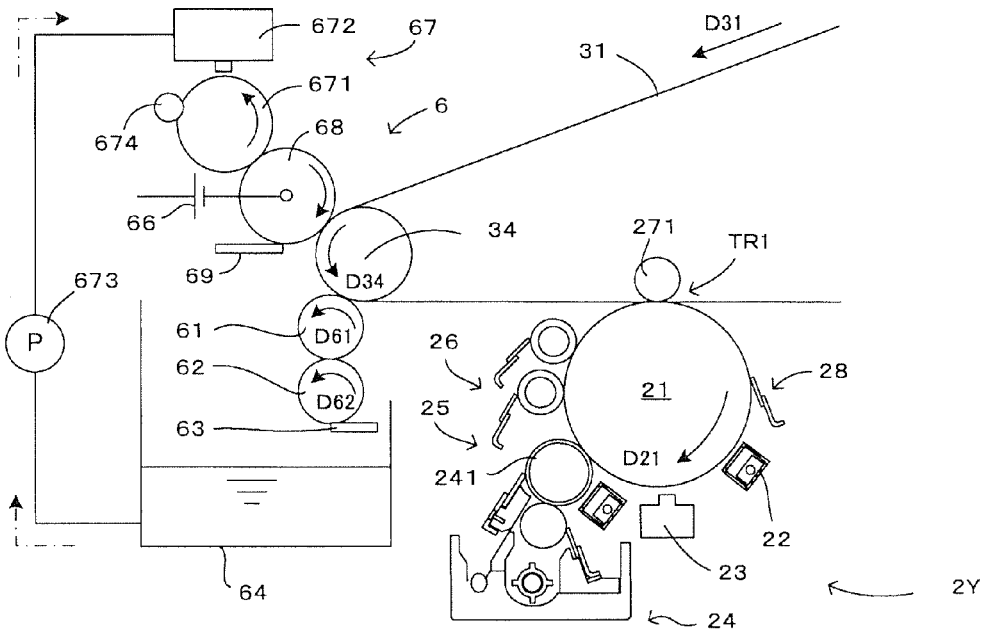
FIG. 8 is a drawing representing a fifth embodiment of the cleaning device according to the invention.

FIG. 8 is a drawing showing a fifth embodiment of the cleaning device according to the invention. This fifth embodiment differs significantly from the first embodiment in that the liquid coater 67 is added and a bias cleaning roller 68 is provided, but the configuration is otherwise the same. This bias cleaning roller 68 is in contact with and driven to rotate by the intermediate transfer belt 31 wound on the roller 34 upstream of the cleaning roller 61 in the belt movement direction D31. The coating roller 671 of the liquid coater 67 is in contact with the bias cleaning roller 68, and, as in the fourth embodiment, when the liquid developer stored in the developer recovery box 64 is supplied by the pump 673 to the coating roller 671 via the liquid coating head 672, the liquid developer is coated on the bias cleaning roller 68 by the coating roller 671. The symbol 674 in the drawing indicates a smoothing roller for evenly smoothing the liquid developer supplied to the coating roller 671 over the roller surface.

The bias generator 66 is electrically connected to the bias cleaning roller 68, and bias voltage is applied with a polarity corresponding to the charged polarity of the toner. Therefore, while the bias cleaning roller 68 supplies liquid developer to the intermediate transfer belt 31 to reduce the solid component percentage in the liquid developer adhering to the intermediate transfer belt 31, at the same time the charged solid content is cleaned and removed by being drawn onto the bias cleaning roller 68 by the bias application. The distal end of the rubber blade 69 comes in contact with the bias cleaning roller 68, and the liquid developer and toner solid components adhering to the bias cleaning roller 68 are scraped off and recovered in the developer recovery box 64.

Figure 9:
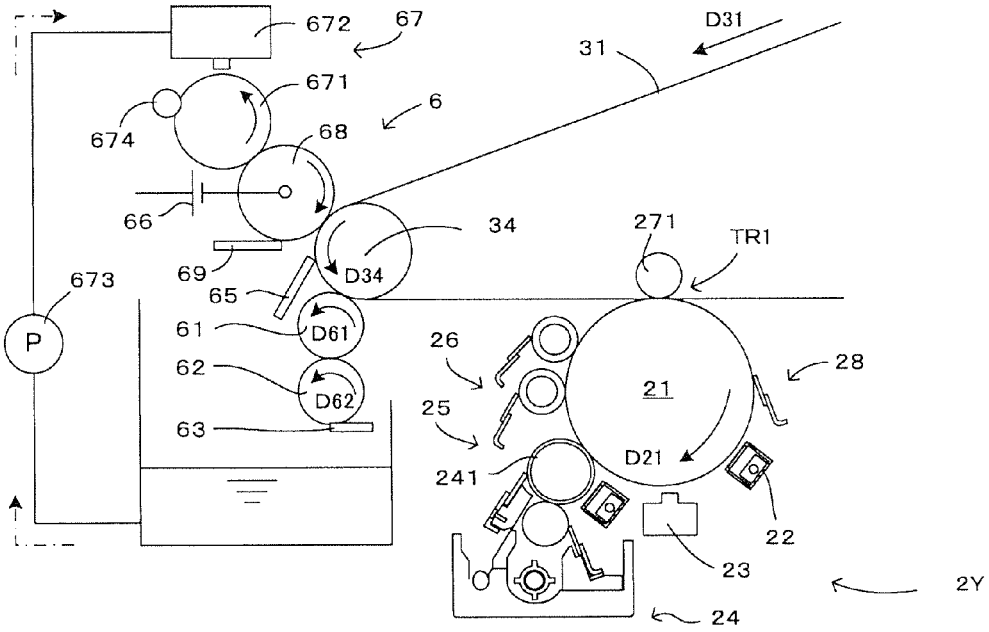
FIG. 9 is a drawing representing a sixth embodiment of the cleaning device according to the invention.

FIG. 9 is a drawing showing a sixth embodiment of the cleaning device according to the invention. This sixth embodiment significantly differs from the fifth embodiment in that a rubber blade 65 is provided, but the configuration is otherwise the same. This rubber blade 65 is arranged so that its distal end contacts the intermediate transfer belt 31 between the positions where the cleaning roller 61 and the bias cleaning roller 68 contact the intermediate transfer belt 31 in the belt movement direction D31. Therefore, the intermediate transfer belt 31 is first bias-cleaned by the bias cleaning roller 68, then blade-cleaned by the rubber blade 65, and finally roller-cleaned by the cleaning roller 61. Thus, excellent cleaning performance is achieved because the front surface region of the intermediate transfer belt 31 is cleaned in sequence by three different cleaning methods. Since the above expressions (2) through (4) are satisfied as described above in the cleaning portion 6 which performs the last of the three belt cleanings, the intermediate transfer belt 31 can be cleaned satisfactorily while the liquid developer removed by the cleaning portion 6 is prevented from re-adhering to the intermediate transfer belt 31, similar to the first embodiment described above.

Figure 10A:
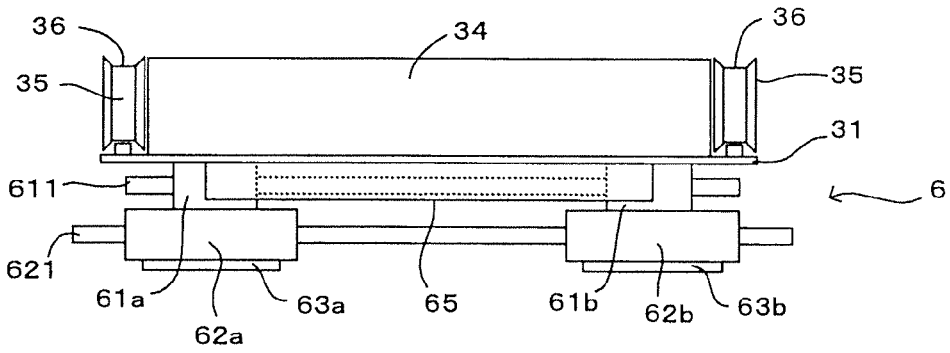
FIG. 10 is a drawing representing a seventh embodiment of the cleaning device according to the invention.
Figure 10B:
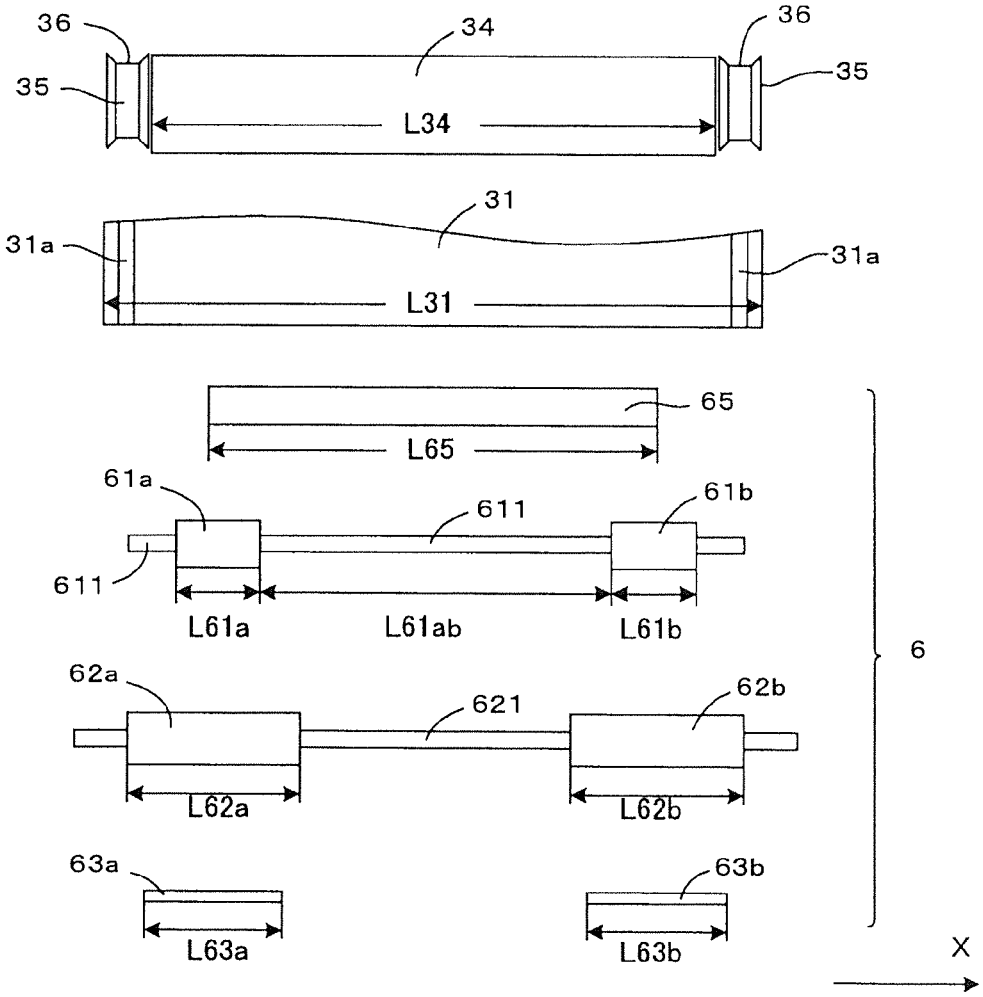

FIG. 10 is a drawing showing a seventh embodiment of the cleaning device according to the invention. This seventh embodiment significantly differs from the sixth embodiment in that the offsetting prevention technique is applied similar to the second embodiment, and two cleaning means configured from the cleaning rollers 61, 62 and the rubber blade 63 are provided. In other words, when the intermediate transfer belt 31 is blade-cleaned by the rubber blade 65, a liquid ring is generated at both ends of the rubber blade 65. To do away with this effect, a single cleaning means (the cleaning rollers 61, 62 and the rubber blade 63) may be provided similar to the sixth embodiment as shown in FIG. 9, for example. However, since the effect of the rubber blade 65 is limited to the end vicinities of the rubber blade 65, the configuration may be designed so that cleaning means (the cleaning rollers 61, 62 and the rubber blade 63) are provided in each of the end vicinities of the rubber blade 65 in order to remove the effect of the rubber blade 65 downstream. More specifically, cleaning rollers 61*a*, 61*b* whose axial lengths are less than that of the cleaning roller 61 are fitted on the rotating shaft 611 so as to face the respective ends of the rubber blade 65, as shown in FIG. 10.

Cleaning rollers 62*a*, 62*b*, which are shorter in axial length than the cleaning roller 62 but longer in axial length than the cleaning rollers 61*a*, 61*b*, are also fitted on the rotating shaft 621 so as to face the respective ends of the rubber blade 65, and are in contact with the cleaning rollers 61*a*, 61*b*. Rubber blades 63*a*, 63*b* shorter than the cleaning rollers 62*a*, 62*b* are fitted so as to face the respective ends of the rubber blade 65. In other words, if the following parameters are defined as indicated below:

L61*a*, L61*b*: Axial lengths of the cleaning rollers 61*a*, 61*b*

L61*ab*: Distance of separation between cleaning rollers 61*a*, 61*b*

L62*a*, L62*b*: Axial length of cleaning rollers 62*a*, 62*b*

L63*a*, L63*b*: Lengths; i.e., widths, of rubber blades 63*a*, 63*b* in axial direction X then when the intermediate transfer belt 31, the cleaning rollers 61*a*, 61*b*, the cleaning rollers 62*a*, 62*b*, and the rubber blades 63*a*, 63*b* are compared, the following dimensional relationships hold true:

$$(L61a+L61ab+L61b)<L31 \quad \text{Expression (7)}$$

$$L61a<L62a \quad \text{Expression (8)}$$

$$L61b<L62b \quad \text{Expression (9)}$$

$$L61a<L63a \quad \text{Expression (10)}$$

$$L61b<L63b \quad \text{Expression (11)}$$

Therefore, in the seventh embodiment, similar to the embodiments described above, the liquid ring can be inhibited from returning to the intermediate transfer belt 31.

Figure 11A:
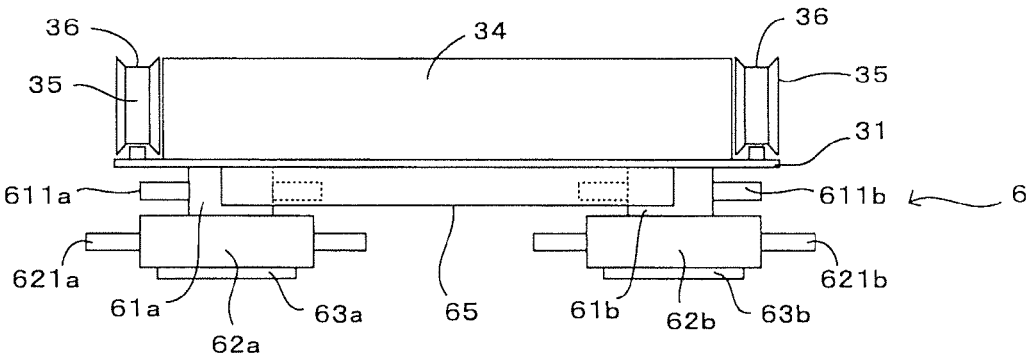
FIG. 11 is a drawing representing an eighth embodiment of the cleaning device according to the invention.
Figure 11B:
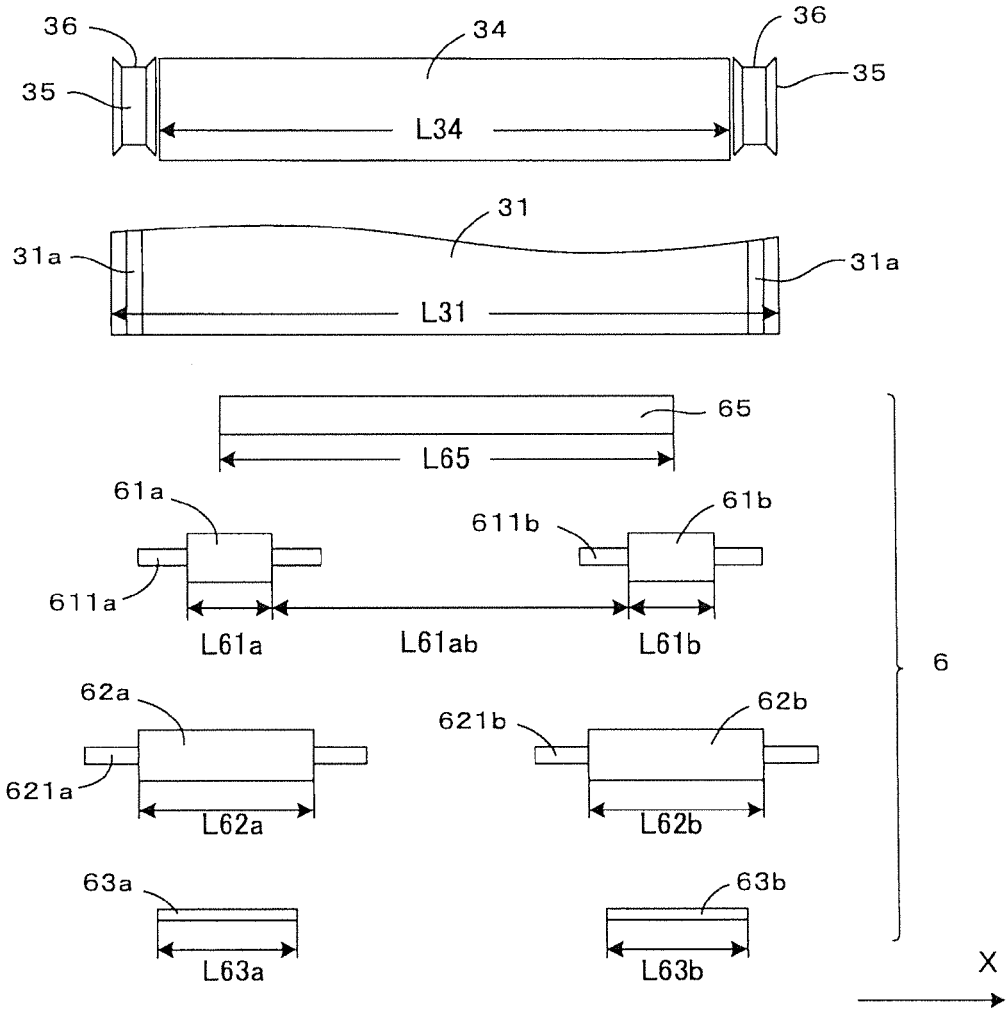

FIG. 11 is a drawing showing an eighth embodiment of the cleaning device according to the invention. This eighth embodiment significantly differs from the seventh embodiment in terms of the axial support of the cleaning rollers 61*a*, 61*b* and the axial support of the cleaning rollers 62*a*, 62*b*. Specifically, in the eighth embodiment, rotating shafts 611*a*, 611*b* are arranged so as to face the respective ends of the rubber blade 65. Cleaning rollers 61*a*, 61*b*, which are shorter in axial length than the cleaning roller 61, are axially supported respectively on the rotating shafts 611*a*, 611*b* so as to be capable of rotating. Rotating shafts 621*a*, 621*b* are also arranged so as to face the respective ends of the rubber blade 65. Cleaning rollers 62*a*, 62*b*, which are shorter in axial length than the cleaning roller 62 and longer in axial length than the cleaning rollers 61*a*, 61*b*, are axially supported on the rotating shafts 621*a*, 621*b* so as to be capable of rotating. Thus, in the eighth embodiment, cleaning means (two cleaning rollers and a rubber blade) capable of inhibiting the liquid ring from returning to the intermediate transfer belt 31 are arranged independent of each other on the ends of the rubber blade 65. The dimensional relationships of the axial lengths and distances of separation are the same as in the seventh embodiment, and the liquid ring can be inhibited from returning to the intermediate transfer belt 31 similar to the embodiments described above.

The invention is not limited to the embodiments described above; various modifications other than those described above can be made so long as they do not deviate from the scope of the invention. For example, the invention can be applied to a cleaning portion which cleans a drum-type intermediate transfer body.

In the embodiments described above, both the rotating direction of the first cleaning roller 61 relative to the intermediate transfer belt 31 and the rotating direction of the second cleaning roller 62 relative to the first cleaning roller 61 are designed to be the counter direction, but these rotating directions are not given by way of limitation.

In the embodiments described above, the invention is applied to a cleaning portion 6 which cleans the intermediate transfer belt 31, an intermediate transfer drum, or another intermediate transfer body, but the invention may also be applied to the cleaning portion 28. In this case, the photoreceptor drum 21 is equivalent to the "image carrier" of the invention.

The applicable scope of the invention is not limited to color image formation devices; the invention can also be applied to monochrome image formation devices.

What is claimed is:

1. A cleaning device comprising:

a first cleaning roller which contacts an image carrier for carrying an image developed using a liquid developer including a toner and a liquid carrier;

a second cleaning roller which contacts the first cleaning roller and has a greater length in an axial direction than the first cleaning roller; and a cleaning blade which contacts the second cleaning roller and has a length in the axial direction of the second cleaning roller that is greater than the first cleaning roller and shorter than the second cleaning roller.

2. The cleaning device according to claim 1, wherein the peripheral surface of the first cleaning roller moves in the opposite direction of the movement direction of the image carrier and makes contact.

3. The cleaning device according to claim 1, wherein the second cleaning roller moves in the opposite direction of the movement direction of the peripheral surface of the first cleaning roller and makes contact.

4. The cleaning device according to claim 1, comprising a second cleaning blade which makes contact with the image carrier; wherein the first cleaning roller makes contact with and cleans the image carrier cleaned by the second cleaning blade.

5. An image formation device comprising:

a developing portion for developing using a liquid developer including a toner and a liquid carrier;

an image carrier for carrying an image developed using the developing portion;

a transfer portion for transferring the image carried on the image carrier onto a transfer member; and a cleaning portion for cleaning the image carrier, the cleaning portion having a first cleaning roller which makes contact with the image carrier via which the image is transferred onto the transfer member in the transfer portion, a second cleaning roller which makes contact with the first cleaning roller and has a greater length in an axial direction than the first cleaning roller, and a cleaning blade which makes contact with the second cleaning roller and has a length in the axial direction of the second cleaning roller that is greater than the first cleaning roller and shorter than the second cleaning roller.

6. The image formation device according to claim 5, wherein the image carrier is a revolving image carrier belt;

the image formation device has a roller on which the image carrier is harnessed; and the length of the image carrier belt in the axial direction of the second cleaning roller is greater than the axial length of the roller, and a bead is set up where the surface of the image carrier belt that makes contact with the roller makes contact with the side surface in the axial direction of the roller and regulates the offsetting of the image carrier belt.

7. An image formation method comprising:

carrying an image developed by using a liquid developer including a toner and a liquid carrier on an image carrier;

transferring the image carried on the image carrier to a transfer member;

cleaning image carrier by causing a first cleaning roller to make contact with the image carrier after the image has been transferred to the transfer member;

cleaning the first cleaning roller by causing a second cleaning roller to make contact with the first cleaning roller, the second cleaning roller having greater length in an axial direction than the first cleaning roller;

cleaning the second cleaning roller by casing a cleaning blade to make contact with the second cleaning roller, the cleaning blade having a length in the axial direction of the second cleaning roller that is greater than the first cleaning roller and shorter than the second cleaning roller.

* * * * *